US008087190B1

(12) United States Patent
Rivera-Andrianakos

(10) Patent No.: US 8,087,190 B1
(45) Date of Patent: Jan. 3, 2012

(54) CLOTHING COORDINATION SYSTEM

(76) Inventor: J. Rebecca Rivera-Andrianakos, Greenwood Village, CO (US)

( * ) Notice: Subject to any disclaimer, the term of this patent is extended or adjusted under 35 U.S.C. 154(b) by 224 days.

(21) Appl. No.: 12/646,016

(22) Filed: Dec. 23, 2009

(51) Int. Cl.
*G09F 7/22* (2006.01)

(52) U.S. Cl. ..... 40/312; 40/611.06; 40/606.03; 211/89.01; 211/70.6; 211/189

(58) Field of Classification Search ..... 206/281; 40/312, 606.14, 606.13, 607.01; 211/206, 211/89.01, 124, 70.6, 189, 119.003, 105.1; 215/386–400
See application file for complete search history.

(56) References Cited

U.S. PATENT DOCUMENTS 3,040,448 A 6/1962 Paxton
3,775,775 A 12/1973 Mazzenga
4,723,665 A 2/1988 Benedict et al.
D301,812 S 6/1989 Handler et al.
4,854,880 A 8/1989 Nasby
7,296,697 B2 11/2007 Costa et al.
2006/0169783 A1 8/2006 Gagne

*Primary Examiner* — Casandra Davis

(57) ABSTRACT

A clothing coordination system comprising first placards labeled with a color and number; second placards labeled with a color; third placards labeled with a number; label apparatuses for attaching to a closet rod to group together pants, shirts, or sweaters of a color, the apparatuses each comprises an elongated base with a rail adapted to display a first placard or a second placard and at least one third placard, wherein the placards corresponds to the color of the pants, shirts or sweaters; and a plurality of clothing boxes for grouping shirts or sweaters of a certain color, the clothing boxes each have at least one rail for displaying a second placard and at least one third placard; wherein a coordinated outfit can be chosen by selecting a pair of pants and then selecting a shirt that has a third placard that matches the assigned number of the pants.

17 Claims, 7 Drawing Sheets

CLOTHING COORDINATION SYSTEM

FIELD OF THE INVENTION

The present invention is directed to a color identification system for clothing. More particularly, the present invention is directed to a clothing coordination system for assisting colorblind individuals in selecting color-coordinated clothing.

BACKGROUND OF THE INVENTION

Color blindness is a vision deficiency, and colorblind individuals have an inability to perceive differences between some of the colors that other individuals can distinguish. It is most commonly a result of a genetic abnormality, but it may also occur because of eye, nerve, or brain damage, or due to exposure to certain chemicals. Because of the vision deficiency, colorblind individuals find it difficult to coordinate clothing. The present invention features a clothing coordination system for assisting a colorblind individual in selecting color-coordinated clothing.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

SUMMARY

The present invention features a clothing coordination system. The system comprises a plurality of first placards, each first placard being labeled with both a color and a number; a plurality of second placards, each second placard being labeled with a color; a plurality of third placards, each third placard being labeled with a number; a plurality of first label apparatuses for attaching to a closet rod in a closet via an attachment means, each first label apparatus functions to group together pants of a color, the first label apparatuses each comprises an elongated base having a first end and a second end, wherein a rail disposed is on a front surface of the base, the rail is adapted to display a first placard, wherein the first placard corresponds to the color of the pants and provides the color of the pants an assigned number; a plurality of second label apparatuses for attaching to a closet rod in a closet via an attachment means, each second label apparatus functions to group together shirts or sweaters of a color, the second label apparatuses each comprises an elongated base having a first end and a second end, wherein a rail disposed is on a front surface of the base, the rail is adapted to display a second placard and at least one third placard, wherein the second placard corresponds to the color of the shirts or sweaters and the third placards correspond to an assigned number of a color of pants that the shirt or sweater would match; and a plurality of clothing boxes for grouping shirts or sweaters of a certain color, each clothing box comprises a base platform, a front panel extending upwardly from a front edge of the base platform, a back panel extending upwardly from a back edge of the base platform, and a first side panel extending upwardly form a first side edge of the base platform, wherein the back panel is taller than the front panel, wherein the clothing boxes can be connected together via a connecting means; wherein a bottom rail is disposed on the front panel and one or more top rails are disposed along a height of the back panel, the top rails are adapted to display a second placard and the bottom rail is adapted to display one or more third placards; wherein the second placard corresponds to the color of the shirts or sweaters and the third placards correspond to an assigned number of a color of pants that the shirt or sweater would match; wherein a coordinated outfit can be chosen by selecting a pair of pants and then selecting a shirt that has a third placard that matches the assigned number of the pants.

in some embodiments, the color includes white, black, brown, blue, navy, green, jeans, yellow, orange, olive, and cream. In some embodiments, the number includes 1, 2, 3, 4, 5, 6, 7, 8, 9, and 10. In some embodiments, the attachment means is a clamp component disposed on the base, the clamp component functions to securely clamp around the closet rod. In some embodiments, the clamp is attached to the base via a connecting bar. In some embodiments, the clamp component can be tightened via a tightening mechanism. In some embodiments, the label apparatus further comprises a telescopic rod that extends out of the first end or the second end of the base. In some embodiments, the label apparatus further comprises a removable cap disposed on the second end of the base. In some embodiments, the cap can be attached to the closet rod via an attachment means. In some embodiments, the connecting means is a peg-and-aperture system, wherein a peg extends from the first side panel of the clothing boxes, the peg is adapted to engage an aperture disposed on a second side edge of the base panel of a different clothing box.

In some embodiments, the clothing coordination system further comprises a drawer apparatus for holding socks or ties. In some embodiments, the drawer apparatus comprises label apparatuses that can be interconnected via vertical telescopic rods. In some embodiments, the label apparatus can be labeled with a second placard and at least one third placard. In some embodiments, the placards are in Braille or in a language including English, Spanish, Greek, Russian, Korean, French, German, Chinese, Portuguese, or Italian. In some embodiments, the clothing coordination system further comprises a set of instructions and a guide. In some embodiments, the clothing coordination system further comprises labels labeled with a number or a color, the labels can be attached to pants or sweaters or shirts indicate a color of the clothing.

The present invention also features a method of coordinating an outfit. The method comprises obtaining a clothing coordination system comprising a plurality of first placards, each first placard being labeled with both a color and a number; a plurality of second placards, each second placard being labeled with a color; a plurality of third placards, each third placard being labeled with a number; a plurality of first label apparatuses attached to a closet rod in a closet via an attachment means, each first label apparatus functions to group together pants of a color, the first label apparatuses each comprise an elongated base having a first end and a second end, wherein a rail disposed is on a front surface of the base, the rail is adapted to display a first placard, wherein the first placard corresponds to the color of the pants and provides the color of the pants an assigned number; a plurality of second label apparatuses attached to a closet rod in a closet via an attachment means, each second label apparatus functions to group together shirts or sweaters of a color, the second label apparatuses each comprises an elongated base having a first end and a second end, wherein a rail disposed is on a front surface of the base, the rail is adapted to display a second placard and at least one third placard, wherein the second placard corresponds to the color of the shirts or sweaters and the third placards correspond to an assigned number of a color of pants that the shirt or sweater would match; and a plurality of clothing boxes for grouping shirts or sweaters of a certain color, each clothing box comprises a base platform, a front panel extending upwardly from a front edge of the base platform, a back panel extending upwardly from a back edge of the base platform, and a first side panel extending upwardly form a first side edge of the base platform, wherein the back panel is taller than the front panel, wherein the clothing boxes can be connected together via a connecting means; wherein a bottom rail is disposed on the front panel and one or more top rails are disposed along a height of the back panel, the top rails are adapted to display a second placard and the bottom rail is adapted to display one or more third placards; wherein the second placard corresponds to the color of the shirts or sweaters and the third placards correspond to an assigned number of a color of pants that the shirt or sweater would match. The method further comprises assembling the clothing coordination system and organizing pants into the first label apparatuses and shirts or sweaters into the second label apparatuses or the clothing boxes; choosing a pair of pants from a first clothing apparatus and observing an assigned number on the first placard above the pair of pants; and choosing a shirt or sweater from a clothing box or a second apparatus, the clothing box or second label apparatus having a third placard that matches the assigned number of the pair of pants.

DESCRIPTION OF PREFERRED EMBODIMENTS

Referring now to FIG. 1-9, the present invention features a clothing coordination system 100 for assisting an individual (e.g., a color blind individual) in selecting color-coordinated clothing. The system 100 allows a user to coordinate all of his/her clothing in sections by name, color, and number.

Figure 1:
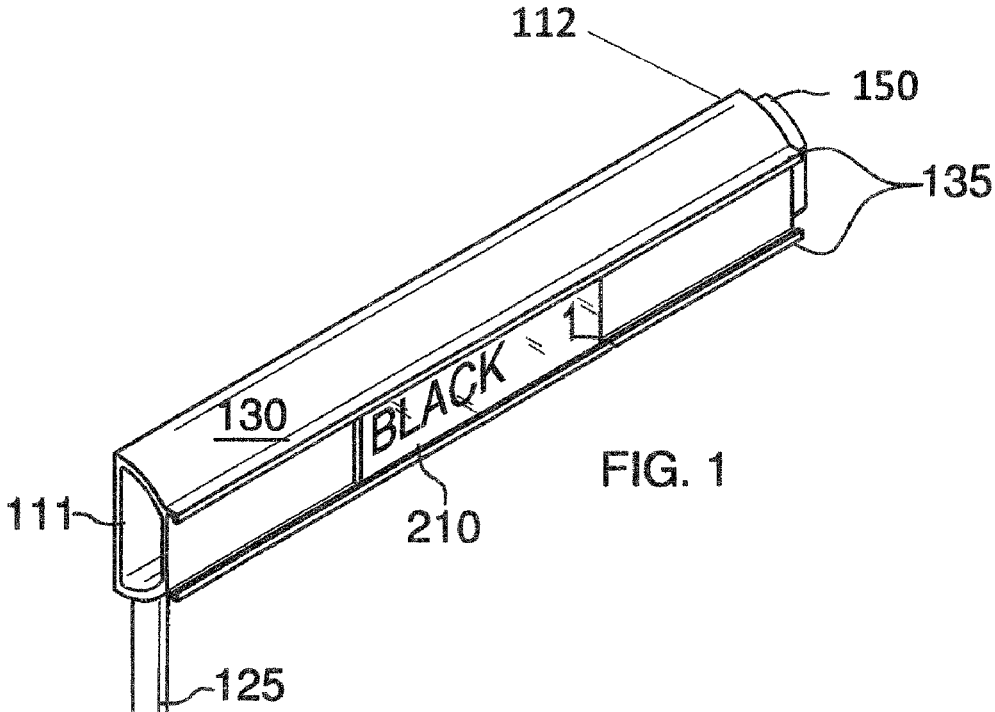
FIG. 1 is a perspective view of the label apparatus of the clothing coordination system of the present invention.
Figure 2:
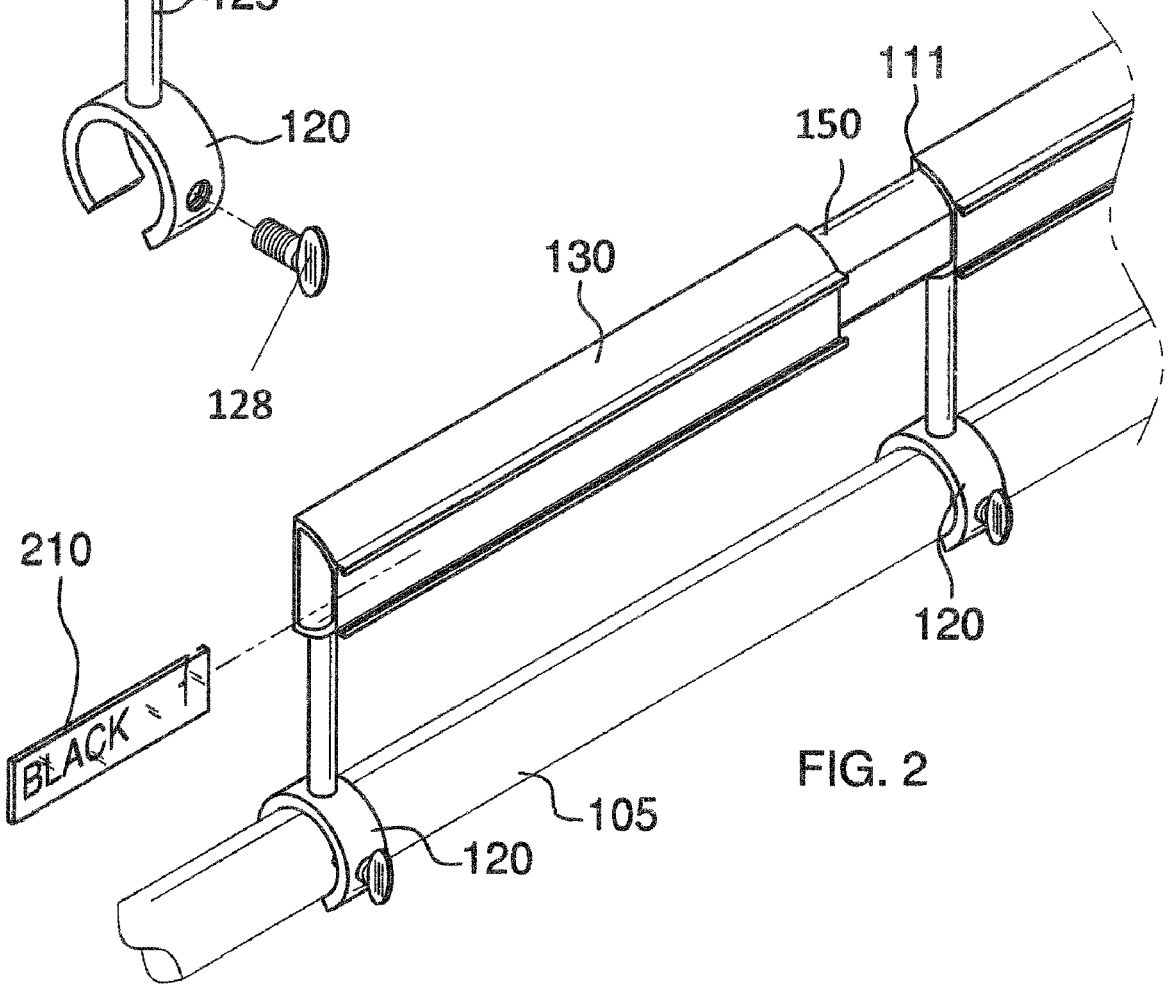
FIG. 2 is an exploded view of the label apparatus of the clothing coordination system of FIG. 1.

The clothing coordination system 100 comprises a label apparatus for installing in a closet, for example attaching to a rod 105 in a closet. The label apparatus comprises an elongated base 130. As shown in FIG. 1, the elongated base 130 has a first end 111 and a second end 112 and a rail 135 disposed on the front surface. The rail 135 is adapted to receive a placard, for example a first placard 210. As shown in FIG. 1 and FIG. 2, the first placard 210 is labeled with both a color and a number. The first placard 210 is used when grouping pairs of pants. Pants are grouped according to colors, for example black, tan/khaki, charcoal or gray, navy, brown, olive, white, etc. Each group/color of pants receives a first placard 210 indicating the color of the pants. Each first placard 210 comes with a number. Examples of first placards 210 include "Black 1," "Grey 2," "Brown 3," "Tan 4," "Olive 5," "Navy 6," "Jeans 7." The first placards 210 are not limited to the aforementioned examples. A user can create his/her own first placard 210 according to the color of the pants (e.g., cream, burgundy, striped, plaid, etc.).

Figure 3:
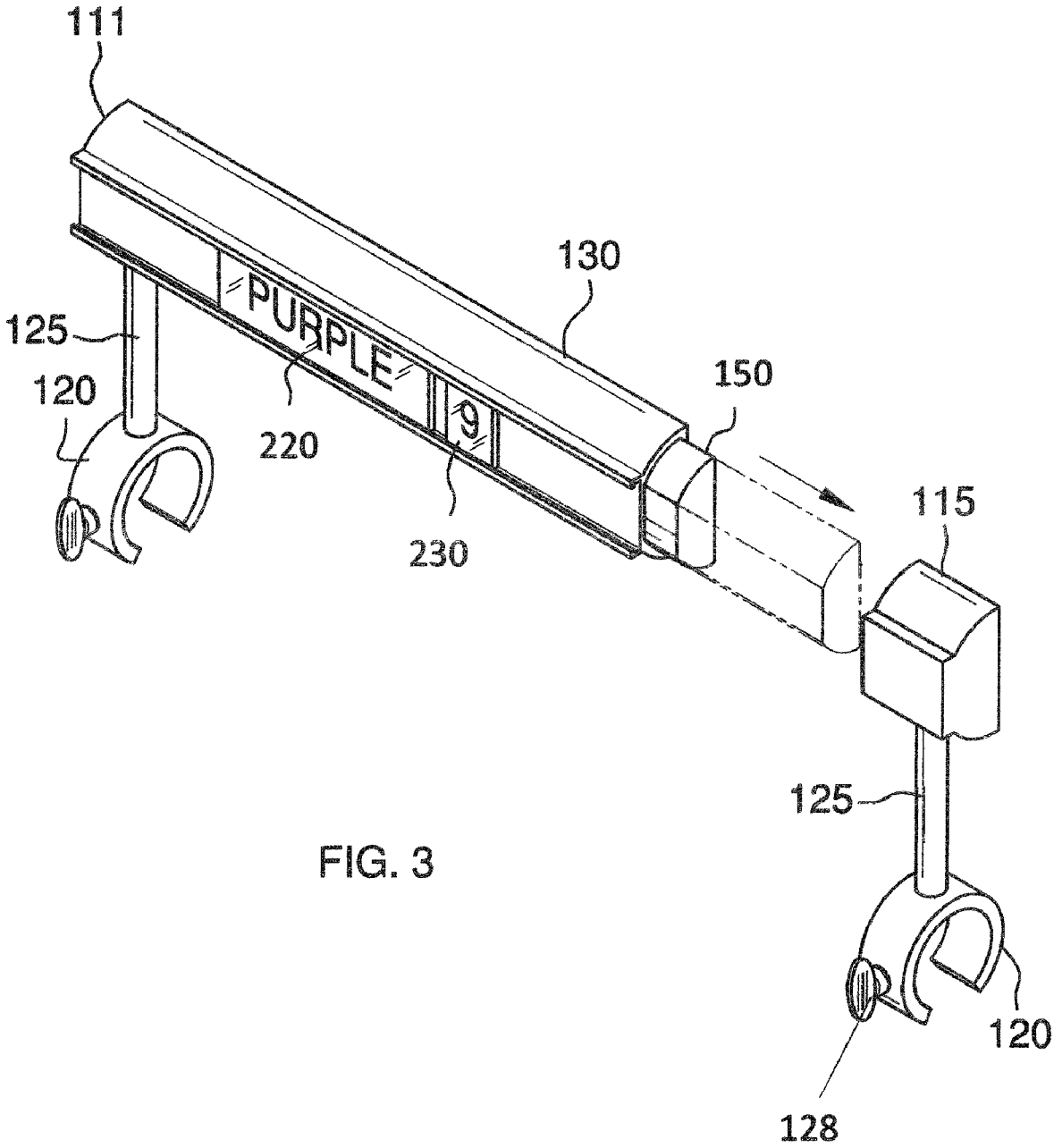
FIG. 3 is a perspective view of the label apparatus of the clothing coordination system of the present invention (the rod is telescopic).

As shown in FIG. 3, in some embodiments, a second placard 220 can be inserted into the rail 135 of the base 130, the second placard 220 being labeled with a color (e.g., white, black, brown, blue, navy, green, yellow, orange, olive, cream, etc). In some embodiments, a third placard 230 can be inserted into the rail 135 of the base 130, the third placard 230 being labeled with a number (e.g., 1, 2, 3, 4, 5, 6, 7, 8, 9, 10, etc.). The second placard 220 and third placard 230 may be used when grouping other clothing items such as sweaters and t-shirts.

In some embodiments, the first placard 210 and/or the second placard 220 and/or the third placard 230 can be labeled with the appropriate color and/or number via writing text, printing text, a sticker, magnets, or other mechanisms. The placards 210, 220, 230 can be slid in and out of the rails. Such rail and placard mechanisms are well known to one of ordinary skill in the art.

The base 130 can be attached to a closet rod 105 via an attachment means. As shown in FIG. 1 and FIG. 2, a clamp component 120 is disposed on the base 130 (e.g., extending downwardly from the base 130). The clamp component 120 functions to securely clamp around the closet rod 105. In some embodiments, the clamp is attached to the base via a connecting bar 125. The attachment means is not limited to a clamp component 120. In some embodiments, the clamp component 120 can be tightened via a tightening mechanism, for example via a screw 128 or bolt mechanism. The tightening mechanism is not limited to the aforementioned examples.

A telescopic rod 150 can extend out of the first end 111 and/or the second end 112 of the base 130. As shown in FIG. 2, the telescopic rod 150 extends outwardly from the second end 112 of the base 130 and further into a first end 111 of a different base 130. This telescopic rod 150 allows the overall width of the base 130 to be elongated as well the base 130 to be connected to a different base 130. A user can thus choose the width of the base 130 as needed. This provides increased versatility and also allows a plurality of label apparatuses to be interconnected within a closet.

As shown in FIG. 3, in some embodiments, the first end 111 or the second end 112 of the base 130 can be covered (e.g., temporarily covered) with a cap 115. This may help prevent the telescopic rod 150 from sliding out of the base 130 unnecessarily. In some embodiments, the cap 115 is attached to the first end 111 and/or the second end 112 of the base 130 when the telescopic rod 150 is not being inserted into a different base 130. Like the base 130, the cap 115 can be attached to the closet rod 105 via an attachment means. As shown in FIG. 3, a clamp component 120 is disposed on the base 130 (e.g., extending downwardly from the base 130), which functions to securely clamp around the closet rod 105. In some embodiments, the clamp is attached to the label platform via a connecting bar 125. The attachment means is not limited to a clamp component 120. In some embodiments, the clamp component 120 can be tightened via a tightening mechanism, for example via a screw 128 or bolt mechanism. The tightening mechanism is not limited to the aforementioned examples.

The label apparatus may be constructed in a variety of shapes and/or sizes. In some embodiments, the base 130 has a cross section that is generally circular, rectangular, trapezoidal, triangular, the like or a combination thereof. In some embodiments, the label apparatus is constructed in a shape and/or size so as not to be too top heavy. In some embodiments, the label apparatus (e.g., not including the attachment means) has a height between about 0.5 to 1.0 inches. In some embodiments, the label apparatus has a height between about 1.0 to 1.5 inches. The label apparatus is not limited to these dimensions.

Figure 4:
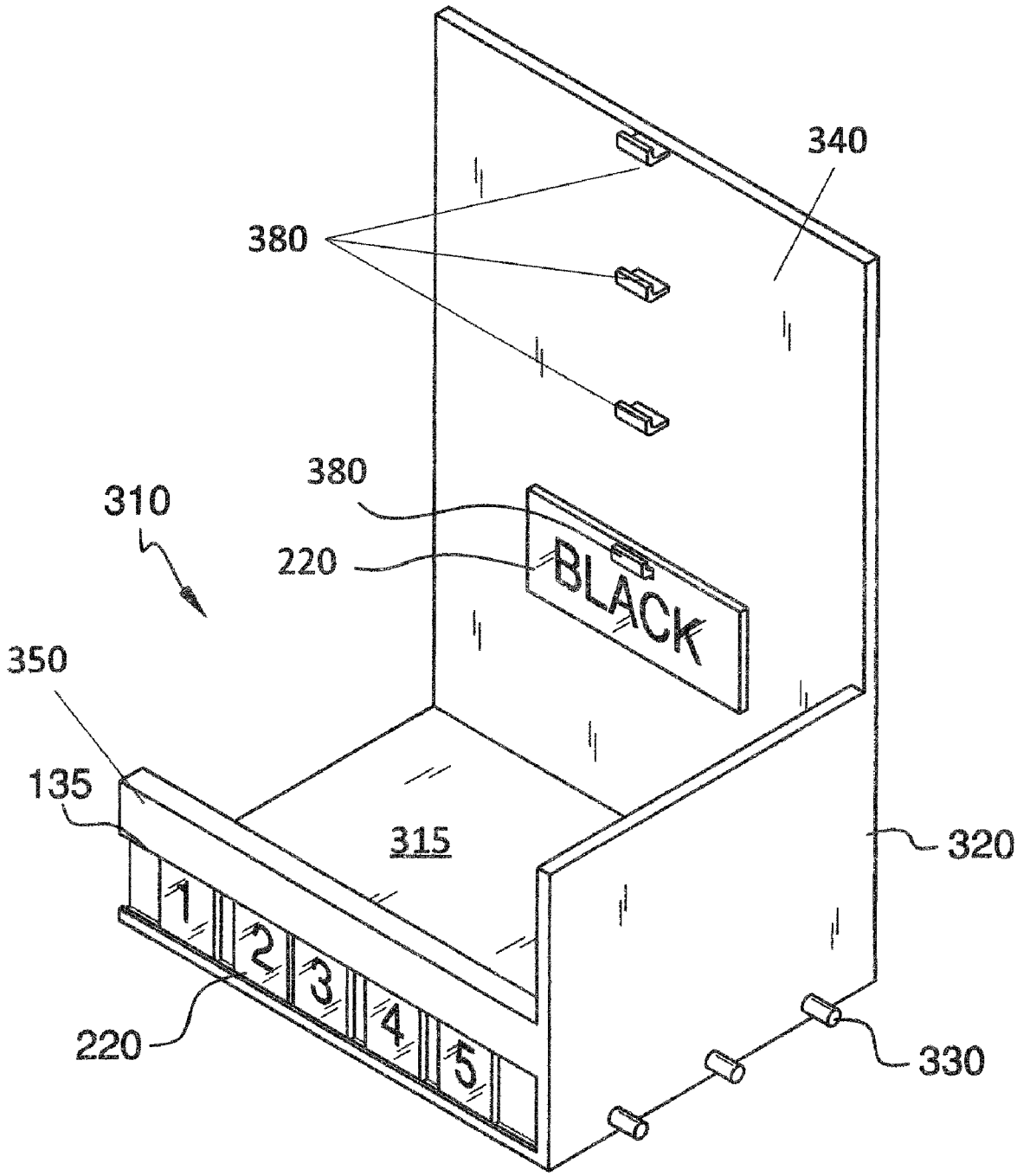
FIG. 4 is a perspective view of the clothing box of the clothing coordination system of the present invention. The color plate can be raised (e.g., about 20 inches) and lowered to position the color plate appropriately.
Figure 5:
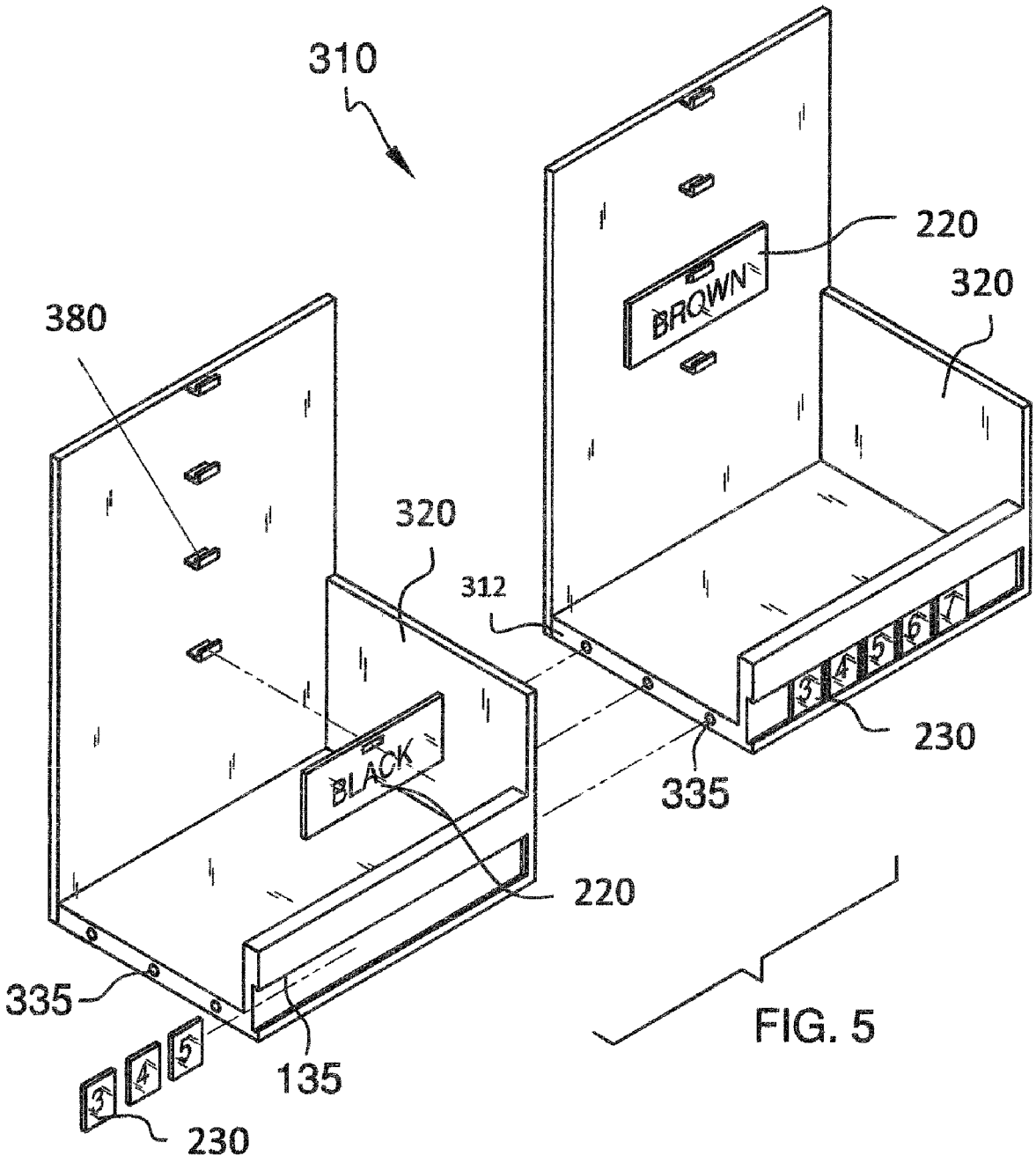
FIG. 5 is an exploded view of clothing boxes of the clothing coordination system of the present invention.

As shown in FIG. 4 and FIG. 5, the system 100 of the present invention further comprises one or more clothing boxes 310 for holding other clothing items including but not limited to shirts (e.g., t-shirts) and sweaters. The clothing box 310 comprises a base platform 315, a front panel 350 extending upwardly from a front edge of the base platform 315, a back panel 340 extending upwardly from a back edge of the base platform 315, and a first side panel 320 extending upwardly form a first side edge of the base platform 315. The front panel 350, the back panel 340, the first side panel 320, and the base panel 315 together form an enclosure that holds the clothing (e.g., sweaters, shirts).

Disposed on the back panel 340 are one or more placard attachment components 380 (or alternatively rails). The placard attachment components 380 (or rails) are adapted to secure a second placard 220 (e.g., with a color) to the back panel (see FIG. 4, FIG. 5). Various placard attachment components 380 may be disposed along the length of the back panel, which allows the placard 220 to be moved upwardly or downwardly until they are in an appropriate position (e.g., if a lot of sweaters are in the clothing box 310 a user may wish to move the placard 220 upwardly so he/she can see it above the sweaters).

Disposed in the front panel 350 is a rail 135 adapted to receive one or more third placards 230 (e.g., numbers). As shown in FIG. 4, the rail 135 holds third placards 230 with the labels "1," "2," "3," "4," and "5."

The clothing box 310 may be constructed in a variety of sizes. Generally, the front panel 350 is shorter in height than the back panels 340. The clothing box 310 may be constructed so as to secure one or more properly folded sweaters and/or shirts (e.g., a large or extra large shirt for a man or a woman, for example). The clothing boxes 310 can be placed on a shelf (e.g., top shelf) or any other shelf (e.g., built-in shelves) in the closet, or on the floor. The clothing boxes 310 are not limited to the aforementioned placements. In some embodiments, the clothing boxes 310 are between about 10 to 15 inches in width (e.g., 14 inches). In some embodiments, the clothing boxes 310 are between about 10 to 16 inches in depth (e.g., 15 inches). In some embodiments, the back panel 340 is between about 10 to 20 inches in height. The dimensions of the clothing boxes 310 are not limited to the aforementioned examples.

Clothing boxes 310 can be interconnected via a connecting means. For example, the connecting means may comprise one or more pegs 330 extending outwardly from the first side panel 320 of the clothing boxes 310. The pegs 330 may engage apertures 335 disposed in the base panels 315 of different clothing boxes 310 (e.g., apertures 335 disposed along the second side edge 312 of the base panel 315. The pegs 330 may snugly fit into the apertures 335, ensuring the clothing boxes 310 stay secured together (e.g., temporarily secured together).

Figure 6:
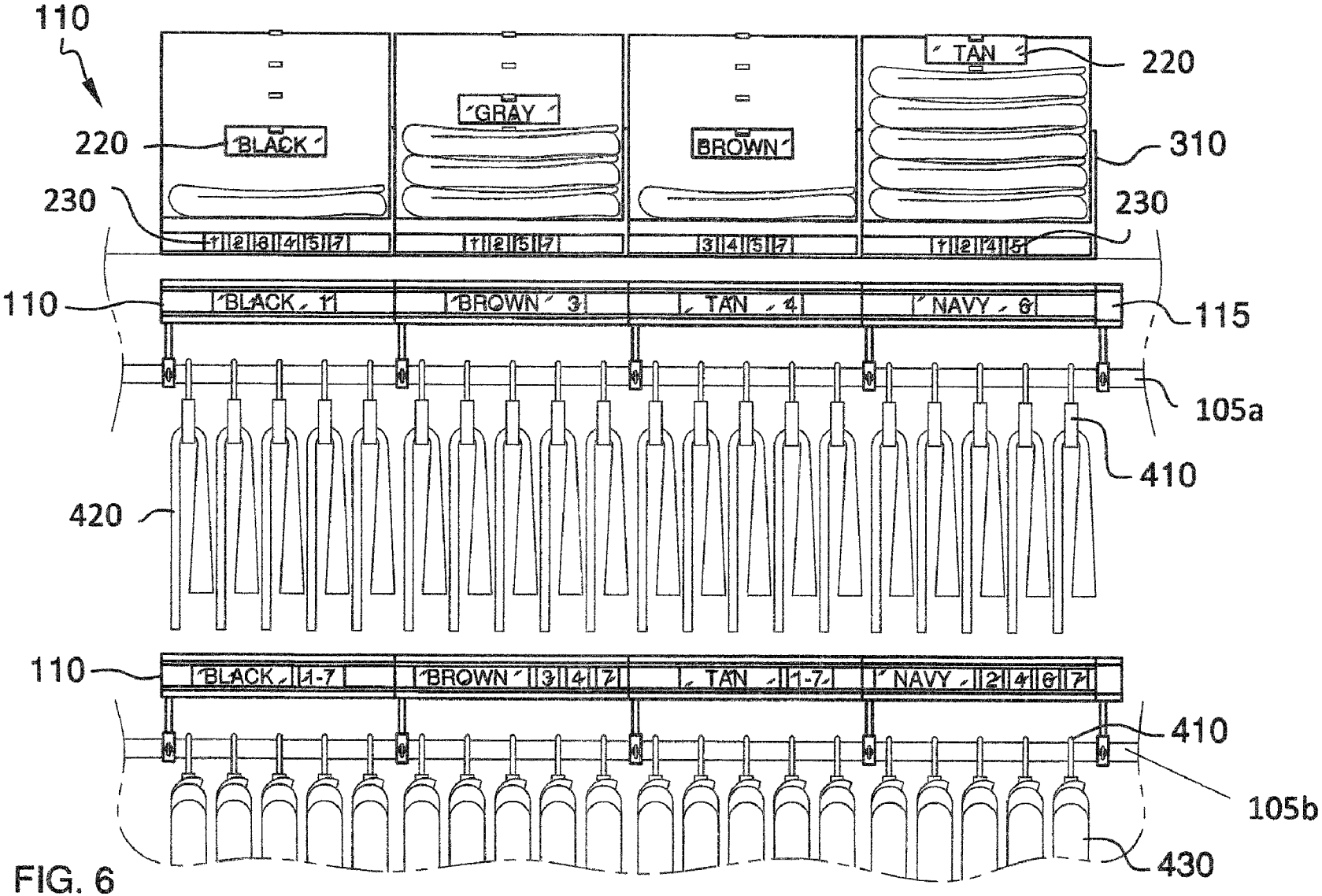
FIG. 6 is a front view of the clothing coordination system of the present invention.

Referring now to FIG. 6, various label apparatuses 110 can be installed in a closet. On the top closet rod 105*a*, four more label apparatuses 110 are connected together. The label apparatuses 110 each have a first placard 210, for example "Black 1," "Brown 2," "Tan 4," and "Navy 6." Pants 420 in those colors are grouped under the label apparatuses 110 (on hangers 410). On the bottom closet rod 105*b*, four label apparatuses 110 are connected together. Each label apparatus 110 has a second placard 220 (colors) and one or more third placards 230 (numbers). Shirts 430 are grouped together under the label apparatuses 110 based on the color (on the second placard 220). The third placards 230 show which color pants 420 coordinate with that particular shirt. A user can first choose a pair of pants, for example a brown pair of pants under the first placard "Brown 3." Then, he/she can look at the shirts for a number "3," which would coordinate with the brown pants. As shown in FIG. 6, the brown shirts (under the placards "Brown 3 4 7") could be chosen, as could the black shirts (under the placards "Black 1 2 3 4 5 6 7), as could the tan shirts (under the placards "Tan 1 2 3 4 5 6 7"). Also shown in FIG. 6 are several clothing boxes 310 with second placards 220 and third placards 230. Shirts or sweaters can be stored in the clothing boxes.

Figure 7:
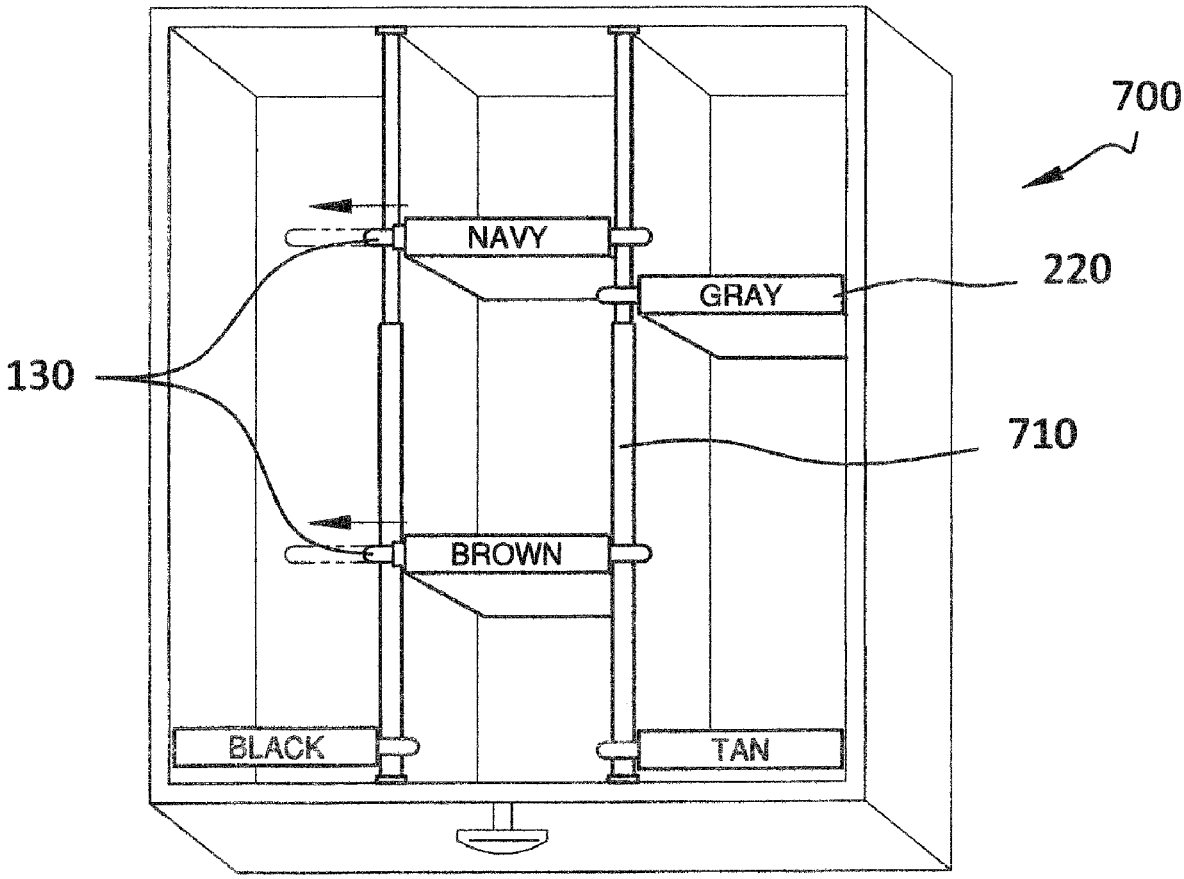
FIG. 7 is a perspective view of a clothing coordination system of the present invention.

In some embodiments, the system 100 of the present invention further comprises a drawer apparatus 700 for holding various items including but not limited to socks, ties, and the like. FIG. 7 shows a drawer apparatus comprising a main housing having an open front. Several label apparatuses (e.g., bases 130) are interconnected via vertical telescopic rods 710. The label apparatuses can be moved upwardly and downwardly along the vertical telescopic rods 710. In addition, the label apparatuses can be widened, for example via the telescopic rods 150. The label apparatus may be labeled with a second placard 220 and/or a third placard 230. The items (e.g., socks, ties) in the drawer apparatus 700 can be labeled by color.

Figure 8:
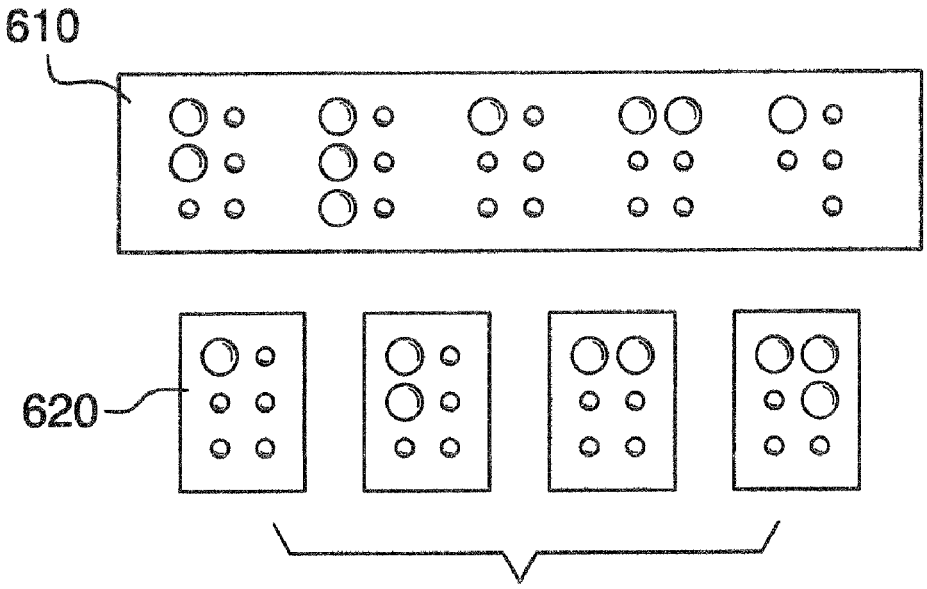
FIG. 8 is a front view of a Braille color plate and a number plate of the clothing coordination system of the present invention.

In some embodiments, the placards 210, 220, 230 are designed as Braille color plates 610 and/or Braille number plates 620 (see FIG. 8). In some embodiments, the placards 210, 220, 230 are labeled in languages including but not limited to English, Spanish, Greek, Russian, Korean, French, German, Chinese, Portuguese, Italian, and the like.

Figure 9:
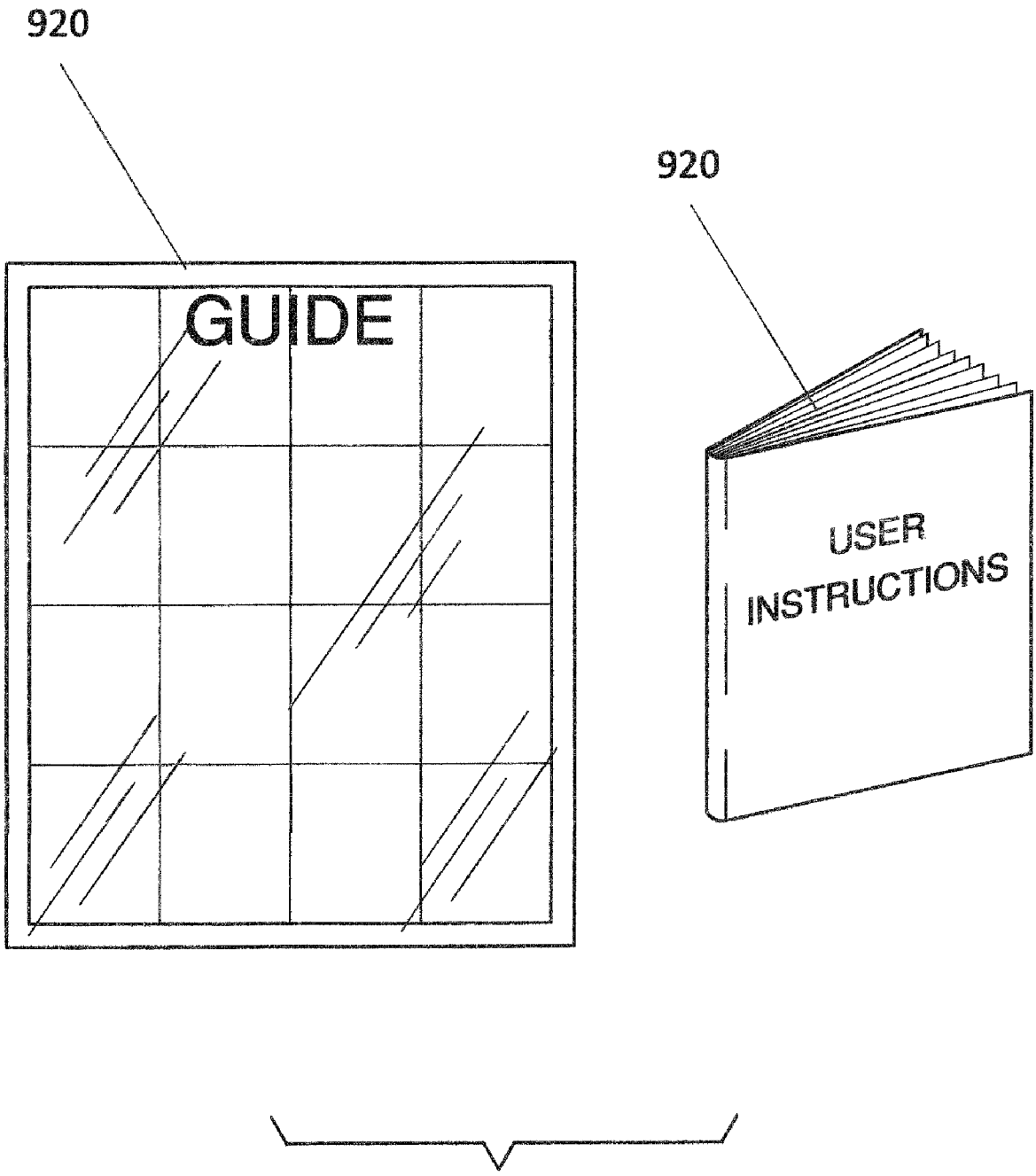
FIG. 9 is a perspective view of a set of instructions and a guide.

As shown in FIG. 9, the system 100 may come with a set of instructions 910 and/or a guide 920 (e.g., a laminated guide). The guide 920 may be displayed near or in the closet.

To use the clothing coordination system 100, a user can first begin by assembling various label apparatuses 110 in a closet. Then, he/she can place first placards 210 in the rails 135 of the label apparatuses and place the appropriate color pants under the placards 210. The user can then place second placards 220 in the rails of other label apparatuses or clothing boxes 310 and sort the shirts or sweaters according to color. Then, third placards 230 can be added to the rails of the other label apparatuses or clothing boxes 310 based on what color pants would coordinate with those shirts. For example, white shirts may be given third placards indicating the white shirts will coordinate with all colors of pants.

Pant choice is the starting point of the system 100. A user first chooses a pair of pants and notes the number on the first placard 210 above the pants. Then, the user can choose a shirt or sweater that also has that number, indicating the shirt will coordinate with that pair of pants.

As an example, user has a black pair of pants, a gray pair of pants, a brown pair of pants, and a khaki pair of pants. He also has a white shirt, a blue shirt, a black shirt, and a navy shirt. The user first places each pair of pants underneath a separate label apparatus, each label apparatus labeled with a first placard 210. The black pair of pants goes under the placard "Black 1," the gray pair of pants goes under the placard "Gray 2," the brown pair of pants goes under the placard "Brown 3," and the khaki pair of pants goes under the placard "Khaki 4."

| Pants | First Placard |
|---|---|
| Black | Black 1 |
| Gray/Charcoal | Gray 2 |
| Brown | Brown 3 |
| Khaki/Tan | Khaki 4 |

The user then places each shirt underneath a separate label apparatus or clothing box. Each label apparatus (or clothing box) is labeled with a second placard 220. The white shirt goes under the placard "white," the blue shirt goes under the placard "blue," the black shirt goes under the "black" placard, and the navy shirt goes under the "navy" placard. Next, third placards (numbers) are added to the label apparatuses or the clothing boxes based on which color pants those shirts would coordinate with. The white shirt receives the placards 1, 2, 3, and 4 because the white shirt would coordinate with all four colors of pants. The blue shirt receives the placards 1, 2, and 4 because the blue shirt would coordinate with the black pants, the gray pants, and the khaki pants. The black shirt receives the placards 1, 2, 3, and 4 because the black shirt would coordinate with all four colors of pants. The navy shirt receives the placards 2 and 4 because the navy shirt would only coordinate with the gray pants (gray 2) and the Khaki pants (khaki 4).

| Shirts | Second Placard | Third Placard |
|---|---|---|
| White | White | 1 2 3 4 |
| Blue | Blue | 1 2 4 |
| Black | Black | 1 2 3 4 |
| Navy | Navy | 2 4 |

Now the user can choose clothing accordingly. The pants are chosen first, and then the other clothing is chosen based on the number system.

The clothing coordination system 100 comprises a kit comprising a plurality of first placards, second placards, and third placards. In some embodiments, the placards are broken down into individual letters (e.g., all letters in the alphabet are provided and a user can combine them accordingly to make words/colors). In this way, a user can assemble custom colors that may not necessarily be provided in a kit (e.g., cream, burgundy). In some embodiments, the kit comprises numbers (e.g., iron-on) that one can attach (e.g., iron on, sew on, etc) to clothing to indicate what color the clothing is. That may assist a user when re-hanging laundered clothing.

The present invention also features methods of choosing an outfit utilizing the clothing system 100 of the present invention.

The following the disclosures of the following U.S. patents are incorporated in their entirety by reference herein: U.S. Pat. No. 3,775,775; U.S. Pat. No. 4,723,665; U.S. Pat. No. 7,296,697; U.S. Pat. No. 3,040, U.S. Pat. No. 4,854,880, U.S. Pat. Application No. 2006/0169783.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. A clothing coordination system comprising:

(a) a plurality of placards, each first placard being labeled with both a color and a number;

(b) a plurality of second placards, each second placard being labeled with a color;

(c) a plurality of third placards, each third placard being labeled with a number;

(d) a plurality of first label apparatuses for attaching to a closet rod in a closet via an attachment means, each first label apparatus functions to group together pants of a color, the first label apparatuses each comprises an elongated base having a first end and a second end, wherein a rail disposed is on a front surface of the base, the rail is adapted to display a first placard, wherein the first placard corresponds to the color of the pants and provides the color of the pants an assigned number;

(e) a plurality of second label apparatuses for attaching to a closet rod in a closet via an attachment means, each second label apparatus functions to group together shirts or sweaters of a color, the second label apparatuses each comprises an elongated base having a first end and a second end, wherein a rail disposed is on a front surface of the base, the rail is adapted to display a second placard and at least one third placard, wherein the second placard corresponds to the color of the shirts or sweaters and the third placards correspond to an assigned number of a color of pants that the shirt or sweater would match; and (f) a plurality of clothing boxes for grouping shirts or sweaters of a certain color, each clothing box comprises a base platform, a front panel extending upwardly from a front edge of the base platform, a back panel extending upwardly from a back edge of the base platform, and a first side panel extending upwardly form a first side edge of the base platform, wherein the back panel is taller than the front panel, wherein the clothing boxes can be connected together via a connecting means; wherein a bottom rail is disposed on the front panel and one or more top rails are disposed along a height of the back panel, the top rails are adapted to display a second placard and the bottom rail is adapted to display one or more third placards; wherein the second placard corresponds to the color of the shirts or sweaters and the third placards correspond to an assigned number of a color of pants that the shirt or sweater would match;

wherein a coordinated outfit can be chosen by selecting a pair of pants and then selecting a shirt that has a third placard that matches the assigned number of the pants.

2. The clothing coordination system of claim 1, wherein the color includes white, black, brown, blue, navy, green, jeans, yellow, or nge, olive, and cream.

3. The clothing coordination system of claim 1, wherein the number includes 1, 2, 3, 4, 5, 6, 7, 8, 9, and 10.

4. The clothing coordination system of claim 1, wherein the attachment means is a clamp component disposed on the base, the clamp component functions to securely clamp around the closet rod.

5. The clothing coordination system of claim 4, wherein the clamp is attached to the base via a connecting bar.

6. The clothing coordination system of claim 4, wherein the clamp component can be tightened via a tightening mechanism.

7. The clothing coordination system of claim 1, wherein the label apparatus further comprises a telescopic rod that extends out of the first end or the second end of the base.

8. The clothing coordination system of claim 1, wherein the label apparatus further comprises a removable cap disposed on the second end of the base.

9. The clothing coordination system of claim 8, wherein the cap can be attached to the closet rod via an attachment means.

10. The clothing coordination system of claim 1, wherein the connecting means is a peg-and-aperture system, wherein a peg extends from the first side panel of the clothing boxes, the peg is adapted to engage an aperture disposed on a second side edge of the base panel of a different clothing box.

11. The clothing coordination system of claim 1 further comprising a drawer apparatus for holding socks or ties.

12. The clothing coordination system of claim 11, wherein the drawer apparatus comprises label apparatuses that can be interconnected via vertical telescopic rods.

13. The clothing coordination system of claim 12, wherein the label apparatus can be labeled with a second placard and at least one third placard.

14. The clothing coordination system of claim 1, wherein the placards are in Braille or in a language including English, Spanish, Greek, Russian, Korean, French, German, Chinese, Portuguese, or Italian.

15. The clothing coordination system of claim 1 further comprising a set of instructions and a guide.

16. The clothing coordination system of claim 1 further comprising labels labeled with a number or a color, the labels can be attached to pants or sweaters or shirts indicate a color of the clothing.

17. A method of coordinating an outfit, said method comprising:

(a) obtaining a clothing coordination system comprising:

(i) a plurality of first placards, each first placard being labeled with both a color and a number; a plurality of second placards, each second placard being labeled with a color; a plurality of third placards, each third placard being labeled with a number;

(ii) a plurality of first label apparatuses attached to a closet rod in a closet via an attachment means, each first label apparatus functions to group together pants of a color, the first label apparatuses each comprise an elongated base having a first end and a second end, wherein a rail disposed is on a front surface of the base, the rail is adapted to display a first placard, wherein the first placard corresponds to the color of the pants and provides the color of the pants an assigned number;

(iii) a plurality of second label apparatuses attached to a closet rod in a closet via an attachment means, each second label apparatus functions to group together shirts or sweaters of a color, the second label apparatuses each comprises an elongated base having a first end and a second end, wherein a rail disposed is on a front surface of the base, the rail is adapted to display a second placard and at least one third placard, wherein the second placard corresponds to the color of the shirts or sweaters and the third placards correspond to an assigned number of a color of pants that the shirt or sweater would match; and (iv) a plurality of clothing boxes for grouping shirts or sweaters of a certain color, each clothing box comprises a base platform, a front panel extending upwardly from a front edge of the base platform, a back panel extending upwardly from a back edge of the base platform, and a first side panel extending upwardly form a first side edge of the base platform, wherein the back panel is taller than the front panel, wherein the clothing boxes can be connected together via a connecting means; wherein a bottom rail is disposed on the front panel and one or more top rails are disposed along a height of the back panel, the top rails are adapted to display a second placard and the bottom rail is adapted to display one or more third placards; wherein the second placard corresponds to the color of the shirts or sweaters and the third placards correspond to an assigned number of a color of pants that the shirt or sweater would match;

(b) assembling the clothing coordination system and organizing pants into the first label apparatuses and shirts or sweaters into the second label apparatuses or the clothing boxes;

(c) choosing a pair of pants from a first clothing apparatus and observing an assigned number on the first placard above the pair of pants; and (d) choosing a shirt or sweater from a clothing box or a second apparatus, the clothing box or second label apparatus having a third placard that matches the assigned number of the pair of pants.

* * * * *